US007386894B2

(12) United States Patent
Straiton

(10) Patent No.: US 7,386,894 B2
(45) Date of Patent: Jun. 17, 2008

(54) TACTICAL OUTER PROTECTIVE SHORTS

(76) Inventor: John P. Straiton, c/o L.B. Technologies, 526 Wolf St., Fredericksburg, VA (US) 24401

( * ) Notice: Subject to any disclaimer, the term of this patent is extended or adjusted under 35 U.S.C. 154(b) by 478 days.

(21) Appl. No.: 11/081,594

(22) Filed: Mar. 17, 2005

(65) Prior Publication Data

US 2006/0206986 A1 Sep. 21, 2006

(51) Int. Cl.
*A41D 13/00* (2006.01)

(52) U.S. Cl. ..... 2/228; 2/2.5

(58) Field of Classification Search ..... 2/228, 2/238, 69, 44, 2.5, 247, 310, 79, 227
See application file for complete search history.

(56) References Cited

U.S. PATENT DOCUMENTS 1,675,234 A * 6/1928 Tarlton ..... 2/230
4,303,239 A * 12/1981 Walsh, Jr. ..... 482/105
4,481,679 A * 11/1984 Hayes ..... 2/463
4,697,285 A 10/1987 Sylvester
5,033,117 A * 7/1991 Fairweather ..... 2/69
5,325,538 A 7/1994 Schoenweiss et al.
5,495,620 A 3/1996 Schoenweiss et al.
5,551,082 A * 9/1996 Stewart et al. ..... 2/465
5,619,748 A 4/1997 Nelson et al.
5,677,029 A 10/1997 Prevorsek et al.
5,926,842 A 7/1999 Price et al.
5,996,115 A 12/1999 Mazelsky
6,049,913 A * 4/2000 Harrigan, Jr. ..... 2/227
6,101,634 A * 8/2000 Martinez ..... 2/238
6,182,288 B1 * 2/2001 Kibbee ..... 2/2.5
6,185,738 B1 2/2001 Sidebottom
6,319,862 B1 11/2001 Czetto, Jr.
6,453,791 B1 * 9/2002 Seitzinger ..... 89/36.05
6,748,601 B2 6/2004 LaShoto et al.
6,846,758 B2 1/2005 Bhatnagar et al.

OTHER PUBLICATIONS

Internet publication, http://www.military.com/soldiertech/0.14632, Saving Ryan's Privates: New "Armored" Shorts Protect Precious Arteries, pp. 1-3, prior to Mar. 2005.
Internet publication, http://www.usmc.mil/marinelink/men2000.nsf/main, Marine Corps News: Marines Testing New Kevlar Shorts in Iraq, pp. 1-2, Jul. 2004.

* cited by examiner

*Primary Examiner*—Tejash Patel
(74) *Attorney, Agent, or Firm*—Wenderoth, Lind & Ponack, L.L.P.

(57) ABSTRACT

The present invention provides a tactical outer protective shorts which is a lower torso body armor and which includes a plurality of ballistic panels each containing a plurality of layers of ballistic material for overlying a lower human torso, a panel carrier garment having the general appearance of a pair of shorts which houses the plurality of ballistic panels, and a shoulder harness connected to the panel carrier garment.

8 Claims, 9 Drawing Sheets

TACTICAL OUTER PROTECTIVE SHORTS

BACKGROUND OF THE INVENTION

1. Field of the Invention

The invention is directed to a body armor designed for protection of the lower torso of a soldier.

2. Description of Related Art

There are numerous types of body armor known for protection of the upper torso. These upper body armors are commonly called ballistic or tactical vests and are today standard issue for soldiers in combat zones. However soldiers are still vulnerable to severe injury or death in the lower torso. Vehicle operators and vehicle gunners are especially vulnerable in the lower torso since their lower torso is exposed during vehicle operation.

Heretofore there has never been developed a body armor for specific protection of the lower torso of a soldier. The term "lower torso" is intended to mean the lower intestines, colon, groin (penis, testicles, vagina), bladder, the soft vulnerable area between the legs near the femoral arteries, anus, lower portion of the back and spine, and the right and left kidney area.

During the Vietnam war, a body armor was developed for protection of the genitals of soldiers. The body armor was worn outside the soldier's uniform and resembled a diaper. However that body armor was uncomfortable to wear and offered very limited protection, since it did not cover the abdomen or legs. The ballistic material used was also far heavier than in use today.

A principal object of the present invention is to provide ballistic protection for the lower torso of a soldier, wherein the lower torso includes the lower intestines, colon, groin, bladder, the soft vulnerable area between the legs near the femoral arteries, anus, lower portion of the back and spine, and the right and left kidney area.

Another object of the present invention is to provide a lower torso body armor that is light in weight, flexible, relatively thin and comfortable to wear.

Another object of the invention is to provide a lower torso body armor that may be worn over the uniform of a soldier in conjunction with an upper torso body armor or tactical vest.

A further object of the invention is to provide a lower torso body armor which may prevent or limit the severity of potential wounds sustained from explosive blasts, shrapnel, bullets and other threats during combat.

A further object of the invention is to provide a single universal size body armor that is adjustable to all lower torso shapes and sizes.

SUMMARY OF THE INVENTION

In the preferred embodiment of the invention, the tactical outer protective shorts have four ballistic panels. The ballistic panels are identified as a first front ballistic panel, a second front ballistic panel, a first rear ballistic panel and a second rear ballistic panel.

The first front ballistic panel overlies the left front lower torso of the user. The second front ballistic panel overlies the right front lower torso of the user. The first rear ballistic panel overlies the left rear lower torso of the user. The second rear ballistic panel overlies the right rear lower torso of the user.

Each ballistic panel comprises a plurality of layers of ballistic material, such as KEVLAR®. The layers of ballistic material of each ballistic panel are preferably contained within a fabric panel cover.

The four ballistic panels protect the lower torso by being positioned over the respective areas of the lower torso in an overlapping arrangement. The four ballistic panels are contained within a panel carrier garment which maintains the ballistic panels in an overlapping arrangement relative to each other. The panel carrier garment is suitable for wearing over a uniform having the general appearance of a pair of shorts. The term "general appearance of a pair of shorts" means that the garment has a waist portion and two leg portions having lower edges which extend to approximately the middle of the thigh of the user. The panel carrier garment comprises a front torso portion and a rear torso portion. The front torso portion contains the first and second front ballistic panels. The rear torso portion contains the first and second rear ballistic panels.

The panel carrier garment is worn by the user with the assistance of a shoulder or suspension harness. The shoulder harness is connected to the front torso portion and rear torso portion of the panel carrier garment.

DETAILED DESCRIPTION OF THE PREFERRED EMBODIMENT

Figure 1:
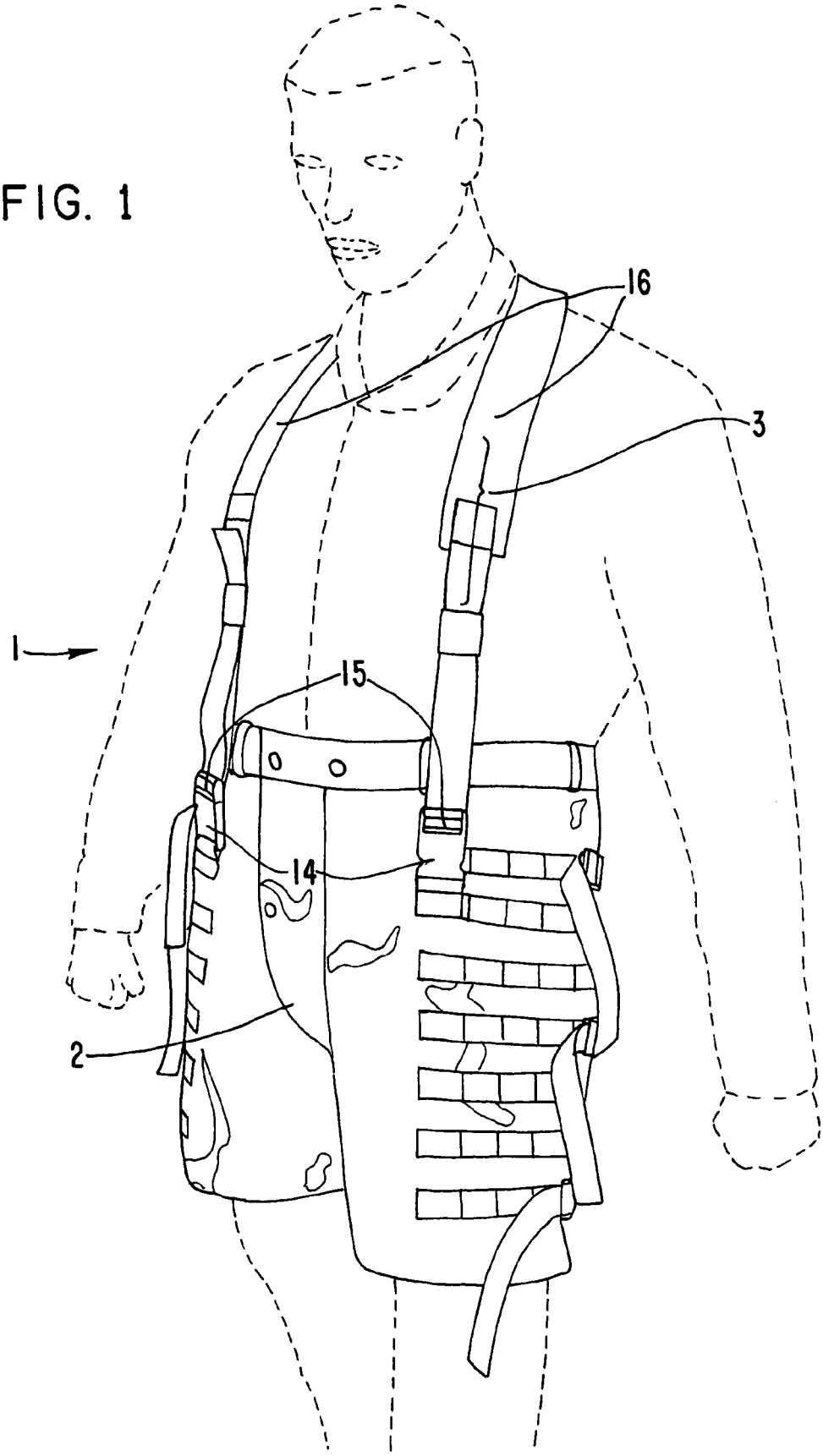
FIG. 1 is a front perspective view of the tactical outer protective shorts of the invention being worn by a user.
Figure 2:
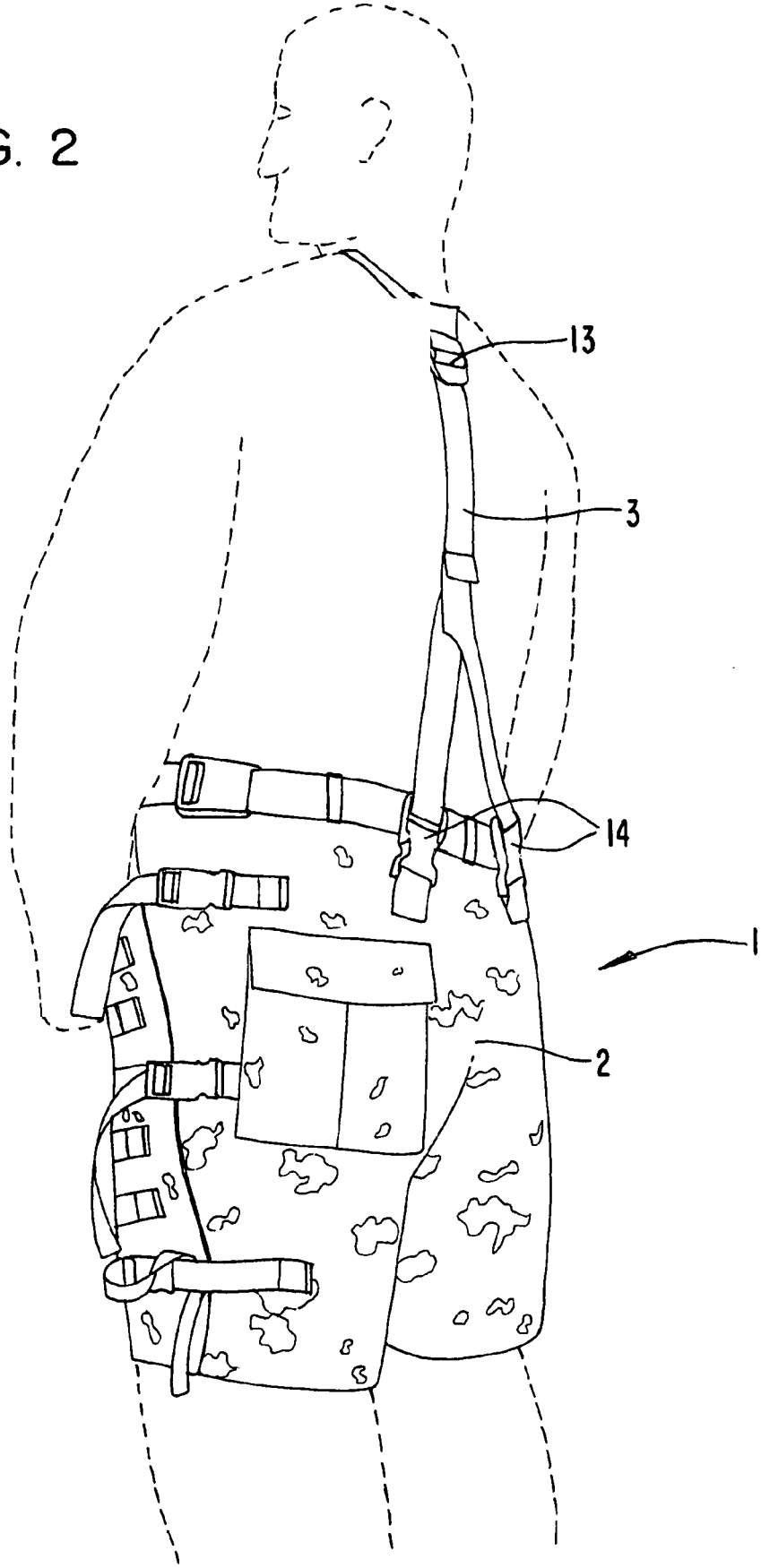
FIG. 2 is a rear perspective view thereof showing the overlapping arrangement of the front and rear torso portions.
Figure 3A:
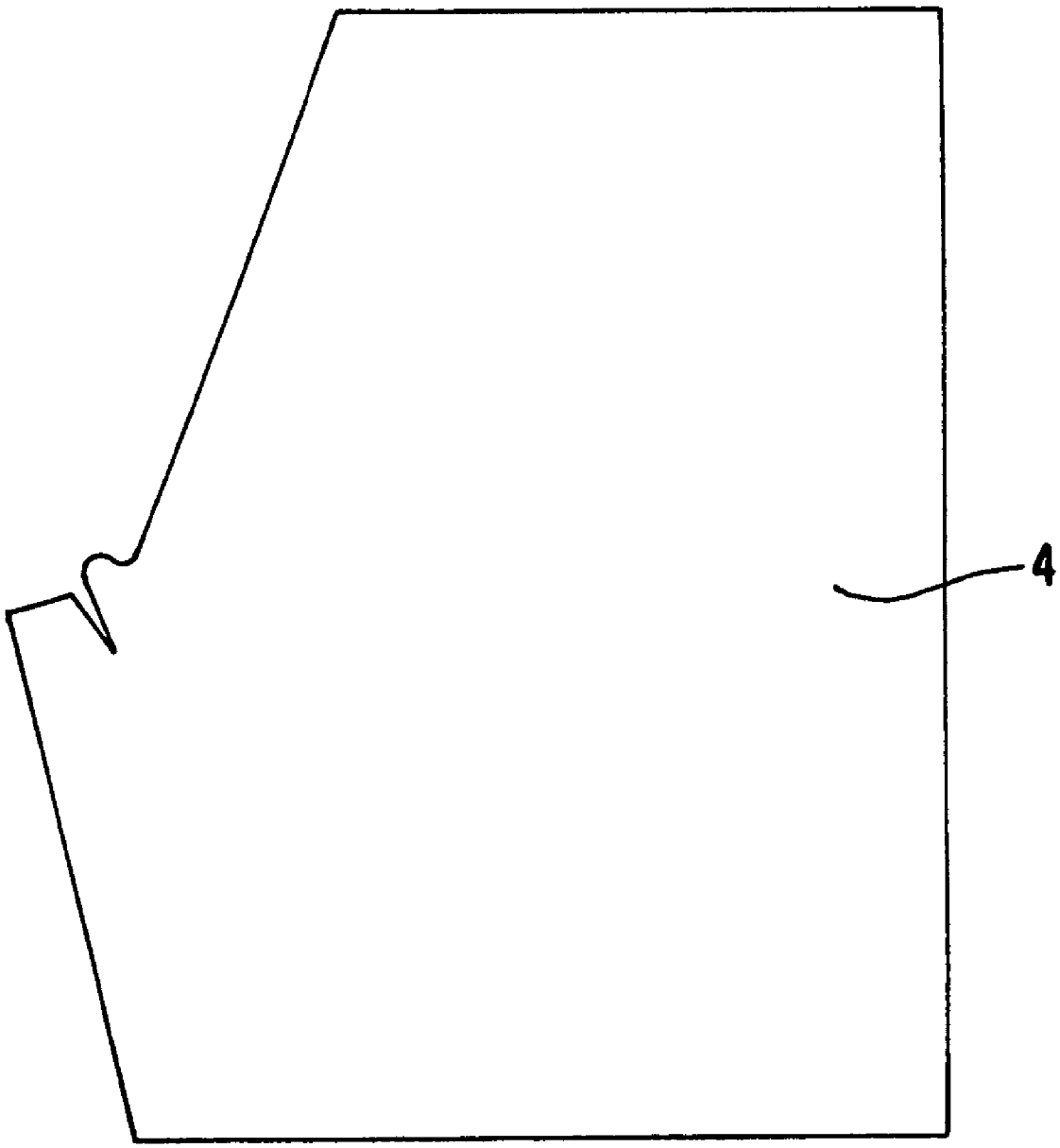
FIG. 3A is a front plan view of the first front ballistic panel.
Figure 3B:
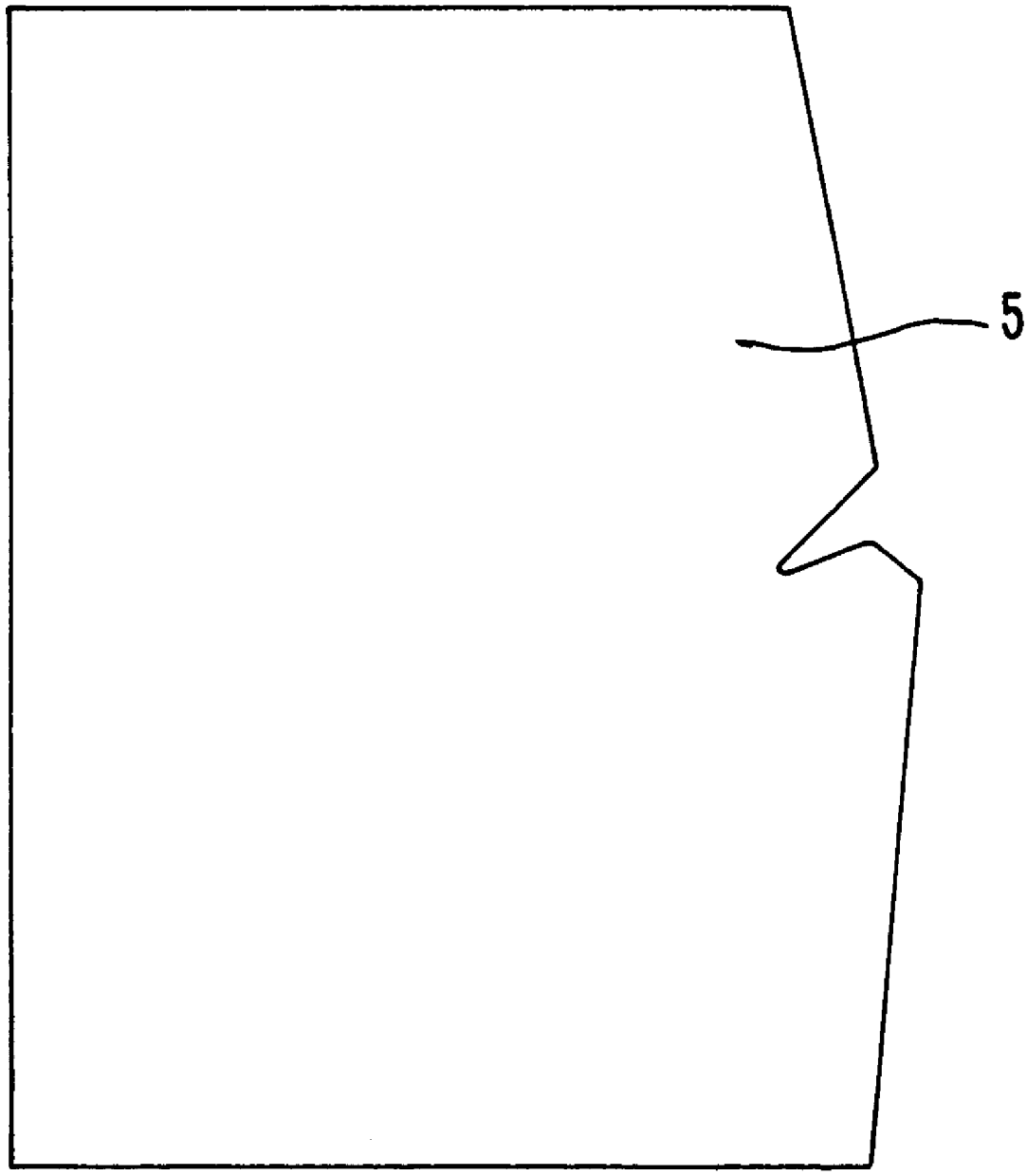
FIG. 3B is a front plan view of the second front ballistic panel.
Figure 3C:
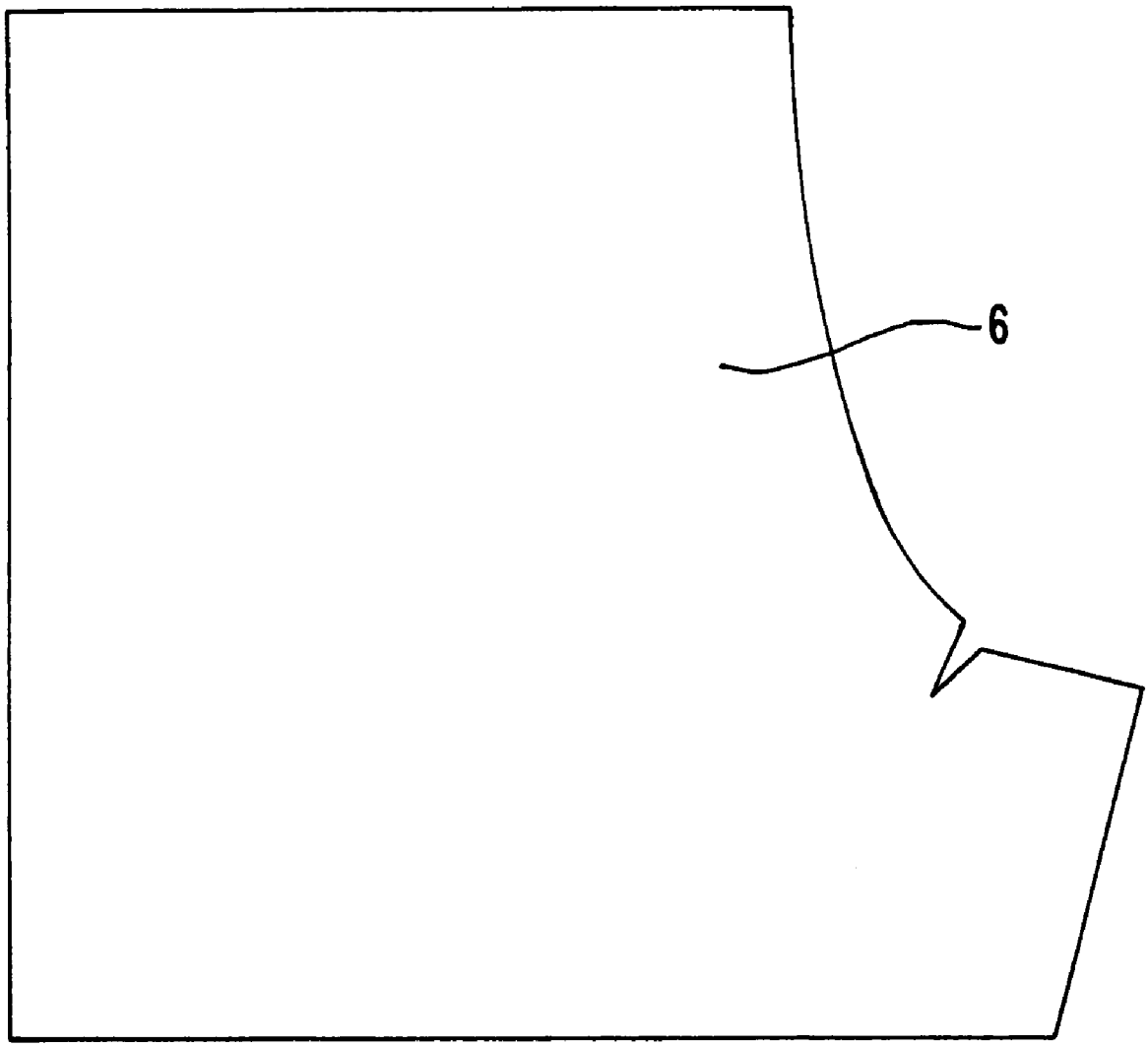
FIG. 3C is a front plan view of the first rear ballistic panel.
Figure 3D:
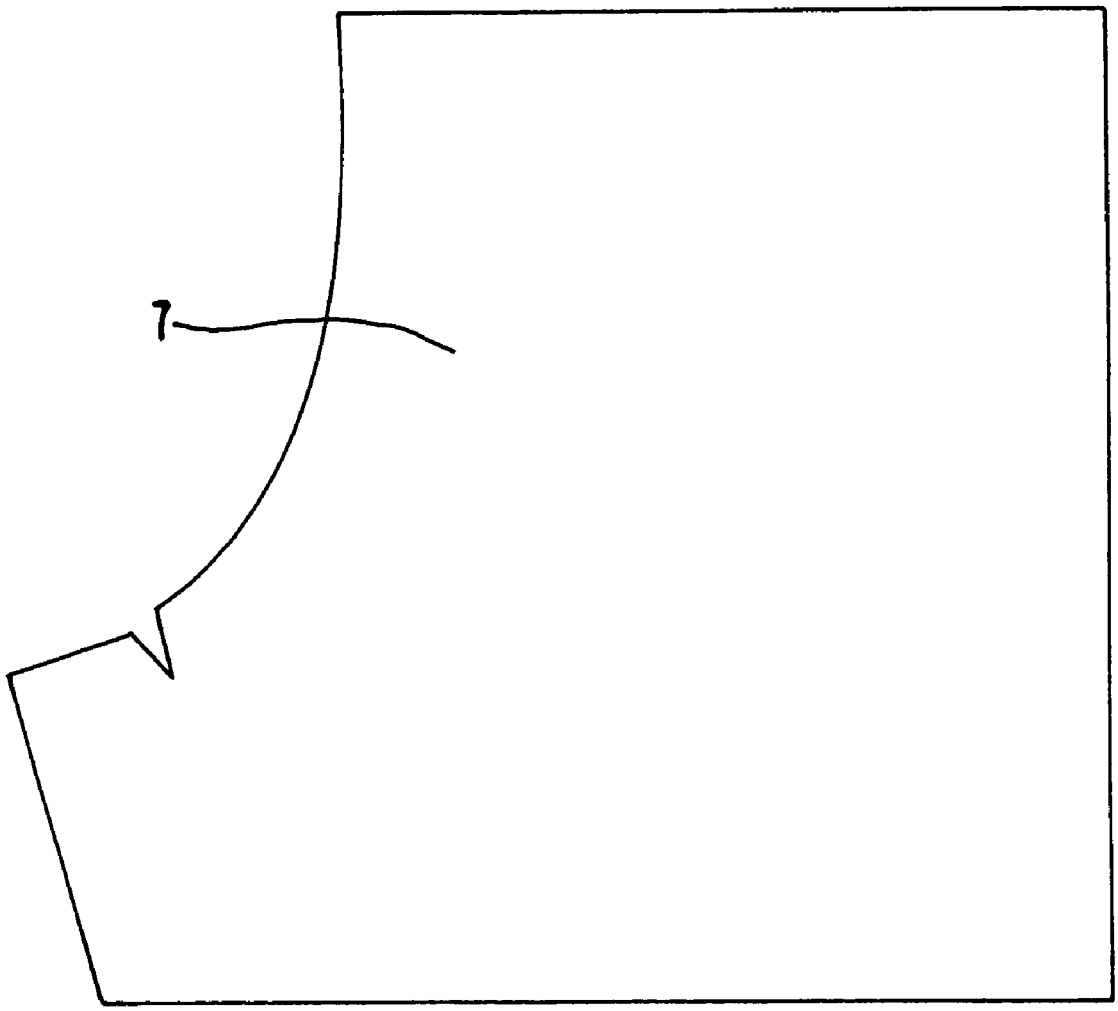
FIG. 3D is a front plan view of the second rear ballistic panel.

The tactical outer protective shorts 1 of this invention are constructed for wearing over a uniform and have the general appearance of a pair of shorts 2 with a shoulder harness 3. See FIG. 1 and FIG. 2.

The tactical outer protective shorts are intended for use by soldiers, especially for vehicle operators and vehicle gunners in combat zones. However the invention is not limited to such military uses and users, but may also include other uses, for example uses in law enforcement by police and SWAT teams, and uses in dangerous sports such as motorcycle racing.

The tactical outer protective shorts of the preferred embodiment of the invention comprise a first front ballistic panel 4 comprising a plurality of layers of ballistic material for overlying the left front lower torso, a second front ballistic panel 5 comprising a plurality of layers of ballistic material for overlying the right front lower torso, a first rear ballistic panel 6 comprising a plurality of layers of ballistic material for overlying the left rear lower torso, and a second rear ballistic panel 7 comprising a plurality of layers of ballistic material for overlying the right rear lower torso. See FIGS. 3A, 3B, 3C and 3D, respectively. The dimensions of the first front ballistic panel are approximately 10 inches wide at the top, 18 inches high, and 14 inches wide at the bottom. The dimensions of the second front ballistic panel are approximately 12 inches wide at the top, 18 inches high, and 14 inches wide at the bottom. The dimensions of the first rear ballistic panel are approximately 14 inches wide at the top, 18 inches high, and 18 inches wide at the bottom. The dimensions of the second rear ballistic panel are approximately 14 inches at the top, 18 inches high and 18 inches at the bottom. Each panel is approximately ¼ inch in thickness consisting of 28 layers of ballistic material layers.

While the preferred embodiment of this invention employs four ballistic panels, it is possible to construct this invention using more than four panels, e.g. 5, 6, 8 or 10. For example, one or more of the ballistic panels may be replaced with two or more separate panels. However using less than four ballistic panels is considered to be undesirable for military purposes, because the use of fewer panels unduly restricts the movement of the user, such as during running or sitting, and is uncomfortable.

The preferred embodiment of this invention is a single universal size body armor that is adjustable to all lower torso shapes and sizes. However the invention optionally may be constructed in different sizes to fit a more limited range of torso shapes and sizes to give a better fit. In such constructions, the sizes of the ballistic panels and torso portions may be easily determined with routine experimentation.

The ballistic material may be any suitable flexible light weight ballistic fabric, such as KEVLAR®. For military uses, the material is preferably a military grade KEVLAR®, such as Style 706, made with DuPont KEVLAR® KM2 brand fiber. The material may preferably have a water repellent finish, such as CS-898 finish.

The number of layers of ballistic material to be used may be determined by the intended use of the body armor, and the characteristics of ballistic material used. In addition, it should be noted that ballistic materials are under continuous development for discovery of new materials which are stronger and lighter in weight. Currently, for military uses, the number of layers of ballistic material made from Style 706 DuPont KEVLAR® KM2 brand fiber to be used is preferably 28 layers. Ballistic tests conducted by the United States Test Laboratory in Wichita, Kans. of the ballistic panels of the invention have demonstrated that 28 layers of ballistic material made from Style 706 DuPont KEVLAR® KM2 brand fiber is effective in preventing penetration of ballistic threats. A ballistic panel may be constructed using more than 28 layers if desired with little increase in weight.

Fewer layers of ballistic material may be used for non-military uses. In such embodiments, the reduced number of layers of ballistic material are more flexible. Hence in such embodiments, the number of ballistic panels may be reduced to two, a single first panel in the front torso portion and a single second panel in the rear torso portion.

The plurality of layers of ballistic material are aligned relative to each other in the same manner as generally employed in ballistic vests. The layers may be sewn or stitched together to maintain their alignment, or they may have a free-floating arrangement known in the art. Preferably the plurality of layers are stitched, using a single stitch down the center of the layers, to maintain the alignment of the layers relative to each other in their protective position. Other stitching methods may be employed as known in the art.

The ballistic panels preferably include a panel cover to maintain the plurality of layers of ballistic material in a flat overlying protective position relative to each other. The panel cover may be made from any suitable material. For military uses, the panel cover material may be any suitable material that meets US military specifications, such as MIL-C-7020 nylon. The panel cover is preferably in the form of a bag which tightly conforms to the shape of the ballistic material layers. The bag is preferably sewn closed to prevent shifting, removal and/or damage of the ballistic material layers.

The four ballistic panels protect the lower torso of the users by being positioned over the respective areas of the lower torso. The four ballistic panels are contained within a panel carrier garment 2 suitable for wearing over a uniform having the general appearance of a pair of shorts. The panel carrier garment 2 comprises a front torso portion 9 and a rear torso portion 10. The front torso portion 9 contains the first and second front ballistic panels 4,5. The rear torso portion 10 contains the first and second rear ballistic panels 6,7.

The panel carrier garment is made from any suitable material, preferably a washable strong nylon fabric. For military uses, the panel carrier garment material must meet US military specifications, such as 500 or 1000 denier, textured nylon, coated, such as MIL-C-43734. Preferably the garment is constructed using 1000 denier fabric on the outside and 500 denier fabric on the inside of the garment. The outside and inside fabrics of each torso portion are sewn to form a pocket in which to hold the ballistic panels. Preferably the pockets are provided with an opening 11 in the waist portion of the garment in which to insert and remove the ballistic panels.

The ballistic panels are preferably held within position in the pockets of the respective front and rear torso portions using a releasable fastener system, such as a hook and loop fastener tape. For military uses, the fastener tape must meet US military specifications, such as A-A-55216 Type II Class 1 hook and loop fastener tape. Preferably a strip of hook or loop tape 12 is sewn to a plurality of locations on the panel cover which are secured to corresponding hook or loop strips sewn to the inside of the panel carrier garment.

Figure 5:
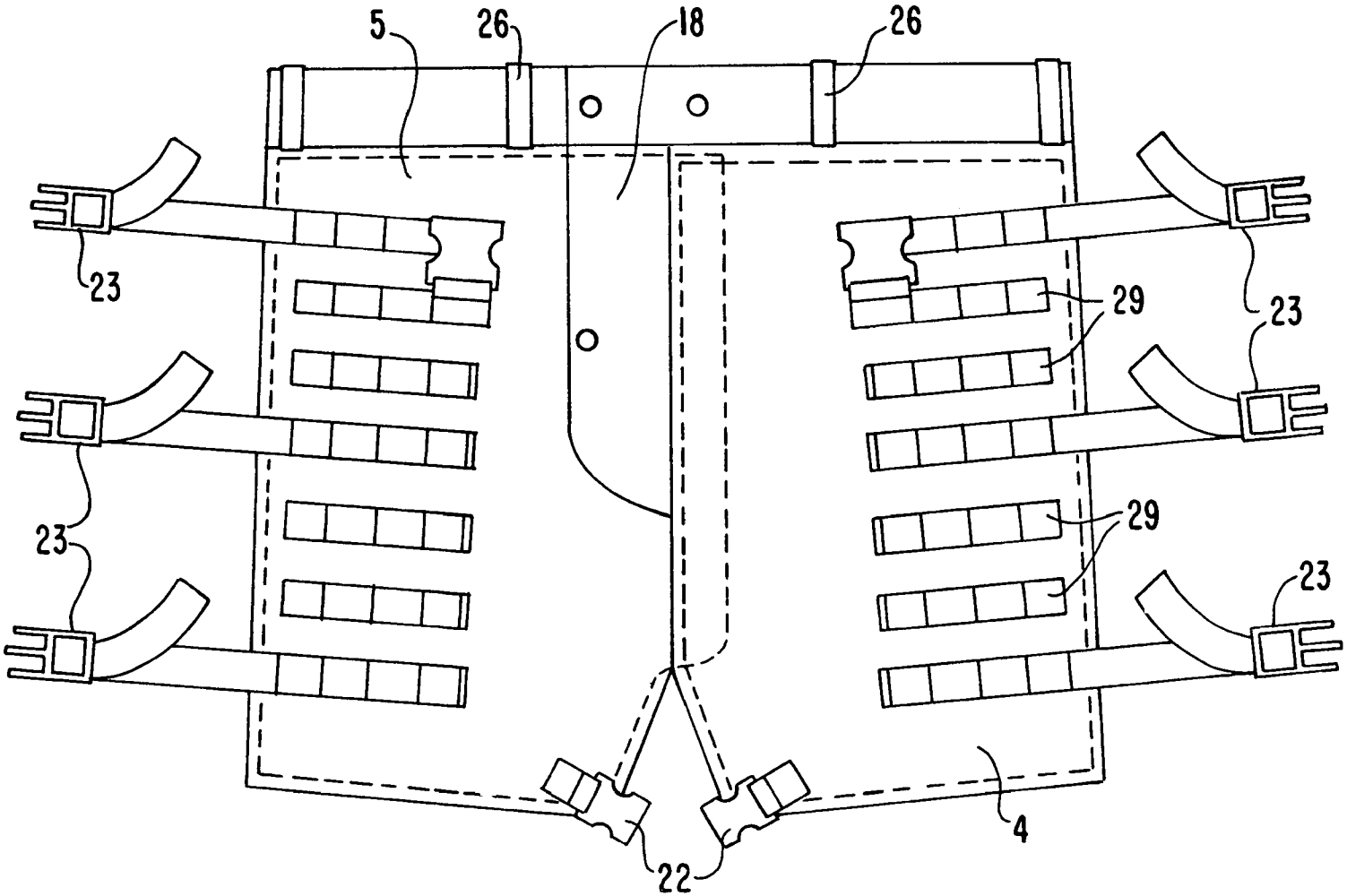
FIG. 5 is a front plan view of the front torso portion thereof showing the overlapping arrangement of the first and second front ballistic panels in broken lines.
Figure 6:
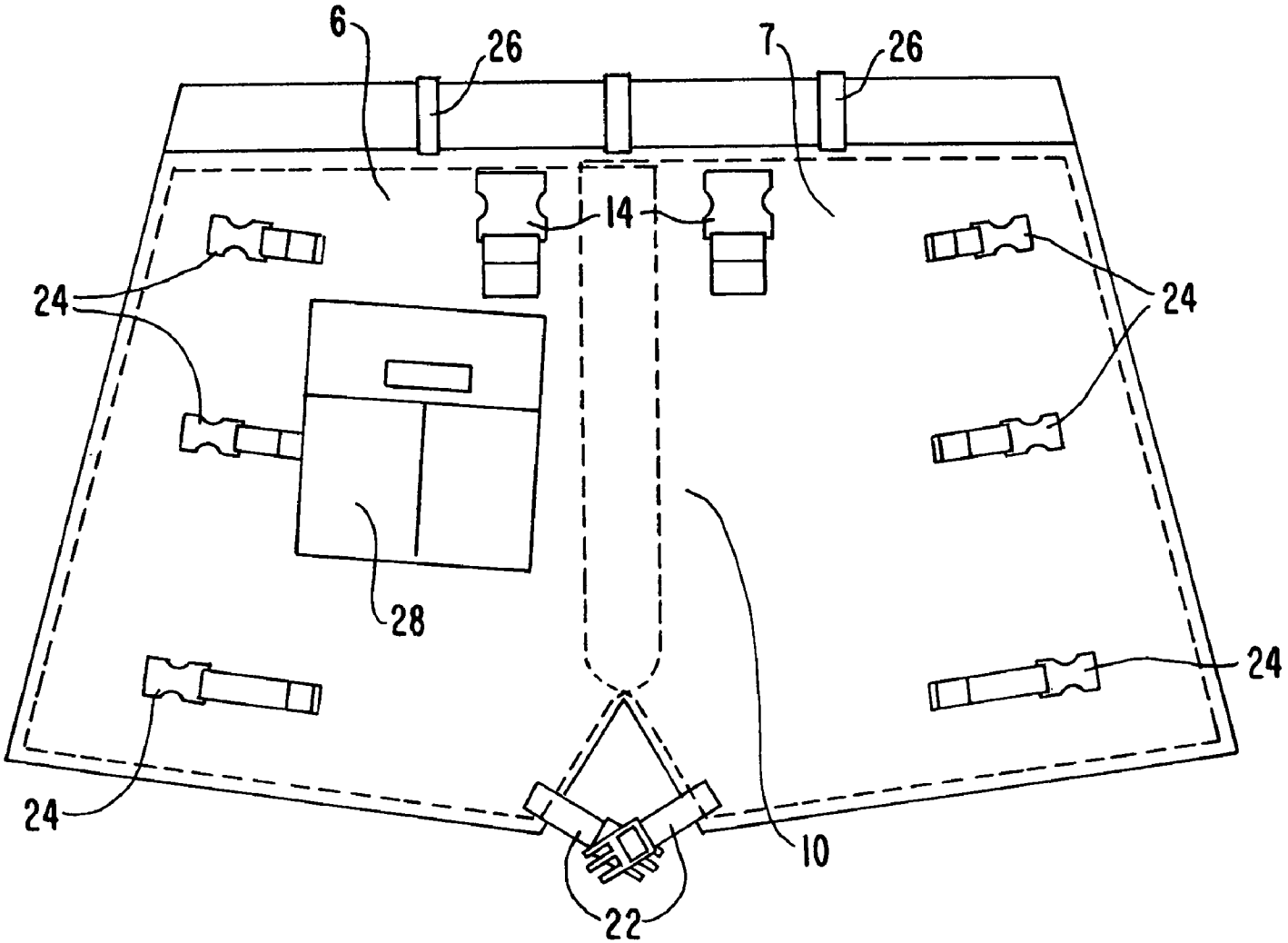
FIG. 6 is a front plan view of the rear torso portion thereof showing the overlapping arrangement of the first and second rear ballistic panels in broken lines.

The ballistic panels themselves are preferably not joined to each other. The front ballistic panels overlap each other in the middle of the front torso portion. In FIG. 5, the broken lines show the overlapping arrangement of the panels 4,5 inside the front torso portion 9. Similarly, the rear ballistic panels overlap each other in the middle of the rear torso portion. In FIG. 6, the broken lines show the overlapping arrangement of the panels 6,7 inside the rear torso portion 10. By securing the ballistic panels to the inside of the rear torso portion and not to each other, the ballistic panels are capable of sliding across each other when the user bends or sits down, making the garment flexible and comfortable. At the same time, the hook and loop fasteners keep the ballistic panels secured in their protective positions overlying their respective areas of the lower torso.

The panel carrier garment is worn by the user with the assistance of a shoulder or suspension harness 3. The shoulder harness comprises a single strap or multiple straps which are connected to the front torso portion and rear torso portion of the panel carrier garment. The shoulder harness may be any construction which supports the weight of the panel carrier garment and ballistic panels. For military uses, the shoulder harness must be constructed according to US military specifications, such as using a 1½ inch webbing, such as MIL-W-17337.

To accommodate different size torsos, the shoulder harness should be adjustable, preferably using adjustable straps and quick release buckles. The shoulder harness may be attached at one position, preferably two positions, on each of the front torso portion and the rear torso portion of the panel carrier garment. The shoulder harness is preferably attached to at least one of the front torso portion and rear torso portion of the panel carrier garment using quick release buckles 14. The quick release buckles are preferably located at each end of the shoulder straps. For military uses, the quick release buckles must meet US military specifications.

The shoulder harness preferably includes a single adjustment buckle 13 at the upper rear of the harness for adjusting the length of the shoulder straps. The shoulder harness further preferably includes left and right adjustment straps 15 on the front ends of the shoulder straps for ease of adjusting the height of the garment on the user. The shoulder harness preferably also includes padded shoulder pads 16.

The panel carrier garment preferably includes a fly zipper 17 disposed in the center of the front torso portion. The fly zipper enables the male user to urinate without removal of the body armor. For military uses, the fly zipper must meet US military specifications, such as a heavy nylon ¾ zipper pull MIL-W-27265. The fly zipper is preferably covered by zipper flap 18, which is preferably held down by a hook and loop fastener tape described above, or a plurality of snap fasteners, such as MIL-F-10884, or more preferably, using both hook and loop and snap fastener systems.

Figure 4:
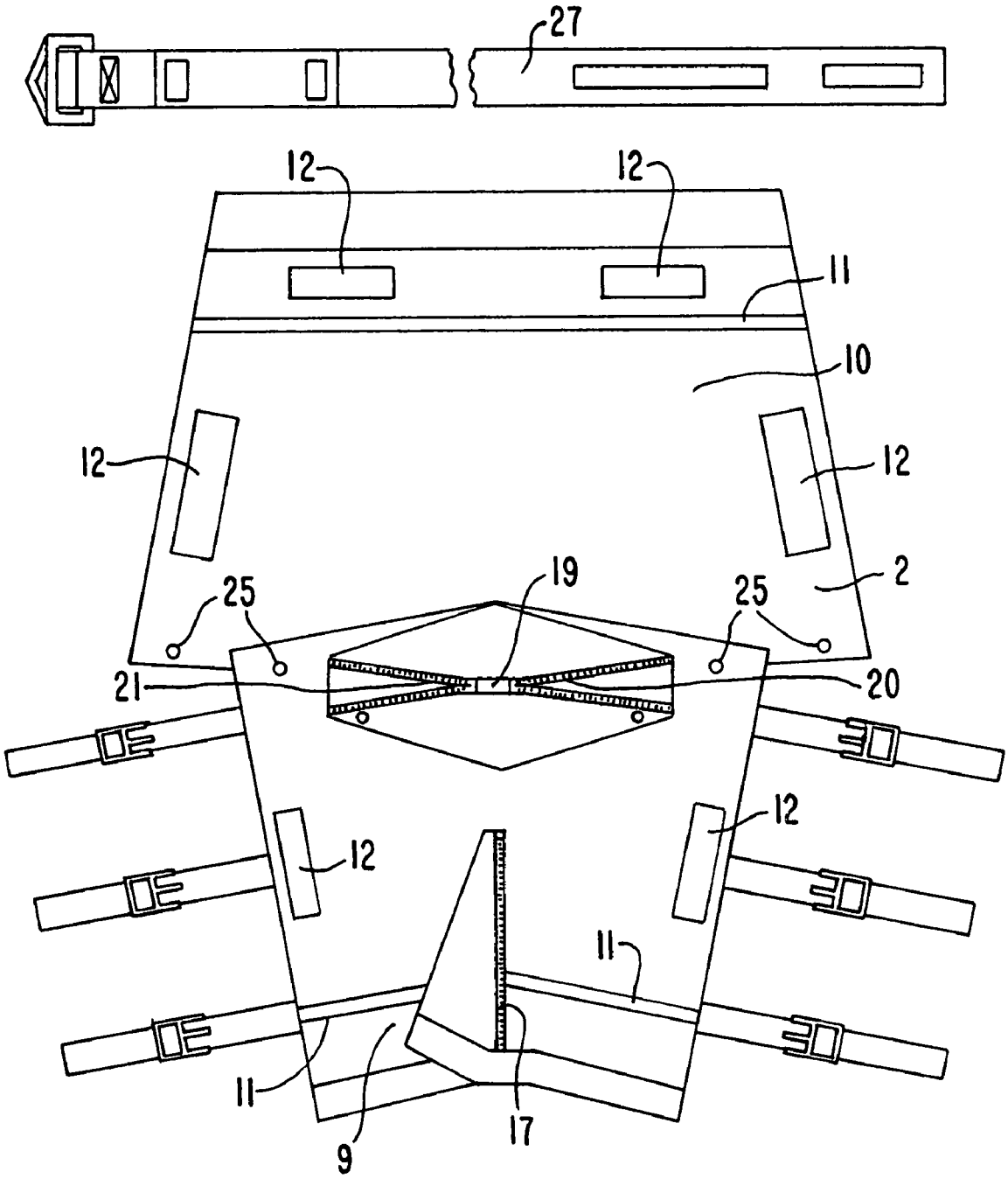
FIG. 4 is a top view of the inside of the tactical outer protective shorts in an open condition.

The front torso portion and the rear torso portion of the panel carrier garment are joined together in the apex of the crotch portion 19. See FIG. 4. On left and right sides of the apex of the crotch portion, there are preferably located zippers 20,21 on each side for closing the inside portions of the legs of the shorts. There preferably are also provided zipper flaps for covering each zipper, which flaps are preferably provided with snaps for securing the zipper flaps in place. Adjustable straps 22 with quick release buckles may also be provided for providing a tight fit of the shorts around each leg of the user.

To accommodate different size torsos, the outside edges of the front and rear torso portions are joined together in an overlapping arrangement using a plurality of adjustable connectors 23. The outside of each leg may have two to four, preferably three, adjustable straps, preferably using quick release buckles 24. The front and rear torso portions of the panel carrier garment must be adjusted by the user to ensure that the edges of the front and rear torso portions overlap to protect the lower torso sides of the user. A user having a smaller torso will have more overlap than a user having a large torso, but even the largest torso will have sufficient overlap of the ballistic panels.

The size of the front and rear torso portions may be any suitable size to protect a user. The tactical outer protective shorts of this invention may be made in a range of sizes to fit different size torsos. In the preferred embodiment of this invention, the tactical outer protective shorts are made in a single universal size to fit all soldiers. In the preferred embodiment, the dimensions of the front torso portion are approximately 20 inches wide at the top of the waist portion, 20 inches from the top of the waist portion to the lower edges of each leg, and 14 inches wide at the lower edge of each leg portion. The dimensions of the rear torso portion are approximately 26 inches wide at the top of the waist portion, 19 inches from the top of the waist portion to the lower edge of each leg portion, and 19 inches wide at the lower edge of each leg portion.

The preferred embodiment of this invention is a single universal size body armor that is adjustable to all lower torso shapes and sizes. However the invention optionally may be constructed in different sizes to fit a more limited range of torso shapes and sizes to give a better fit. In such constructions, the sizes of the front and rear torso portions may be easily determined by routine measurements.

The front torso portion and the rear torso portion of the panel carrier garment preferably have openings 11 on their inside surface for removing the first and second front ballistic panels and the first and second rear ballistic panels from the panel carrier garment. The openings preferably have a flap which can be secured closed using a hook and loop fastener system sewn to the fabric on opposed sides of the opening.

The panel carrier garment preferably includes grommets or eyelets 25 near the bottom edge of the inside of the front and rear torso portions, for providing air ventilation and a means for draining water, in the event of accidental submerging the body armor in water. Suitable eyelets for military use are MIL-E-20652.

The waist portion of the panel carrier garment preferably includes belt loops 26 for accommodating a belt. A belt 27 is preferably provided for helping to hold the garment in proper position around the waist of the user during use. For military uses, the belt may be a 1 23/32 inch width belt such as MIL-W-4088. The belt may include an elastic portion to provide some flexibility and comfort when the user is sitting. The belt may also include a hook and loop strip fastener system in order to fasten the end of the belt securely.

The panel carrier garment may include one or more pockets, such as rear pocket 28. The panel carrier garment 2 may further preferably include straps 29 stitched to the front torso portion which straps are similar to straps found on conventional tactical vests for carrying pieces of equipment, such as magazine pouches, flash bang, chemical grenade pouches, GPS and compass pouches, a holster, bayonet, etc.

The tactical outer protective shorts according to this invention is flexible and light in weight, weighing approximately 12 pounds. The invention provides excellent lower torso protection from ballistic threats.

The following is a description of how to use the preferred embodiment of the invention.

How to Use Instructions

The tactical outer protective shorts of this invention are designed to be worn as an outer garment over the battle dress uniform [BDU].

The shorts should be the first item that you put on in your personal protective system. After looking them over, and before making any adjustment, unsnap the fly flap and unzip the fly zipper. Undo one side of the right and left suspension harness. Set them on the floor in front of you. Step into them as you would a pair of pants. Put your arm through the unopened shoulder strap, and place over your shoulder. Take the opened strap and put it over your other shoulder and snap it in to the corresponding female part of the adjustment buckle, on the front of the shorts. The right and left adjustment straps can now be pulled straight down to pull the unit up. It should ride above your waist and as high as is possible and still be comfortable. If necessary, the single adjustment buckle, on the back at the top of the suspension harness, can be adjusted also.

Zip the front of the shorts [fly] closed and close the zipper flap. Match the hook and loop on the shorts and the flap and close the three snaps.

The tactical outer protective shorts come with a special belt. This belt should be tightened in the same manner as a regular BDU belt. The belt has an elastic insert which will allow the belt to give when the wearer bends over or sets down.

There are three [3] adjustment straps on each side [left and right] of the tactical shorts. Starting at the top, the left and right should be adjusted to gather. The same step should be performed with the second set. Depending on the size of the individual wearer the front side of each leg is designed to over lap the back part. It is important that the amount overlapping be equal on both sides. If it is not, readjust until this is achieved.

Moving to the apex of the shorts, between the legs, in the crotch, there are two zippers, one on the inside of each leg. When both the right and left are pulled down it closes the inside of the legs of the shorts. When pulled down using the snap on the tab of the zipper pull snap each, locking it into place. Now the left and right adjustment straps, on the inside of each leg at the bottom, can pulled tightly and equally on both sides.

The final step in the basic adjustment process of the garment is to the lower left and right quick release buckles on the outside of the shorts. Both sides should be done at the same time.

These last adjustment buckles are designed to allow freer leg movement without lessening the protective value of the unit.

Final adjustment is done by adjusting all the buckles, and tying them off. If these steps are done properly, the shorts will fit uniformly and conform to the user's lower torso. This final adjustment is key to providing the greatest protection and user comfort.

Understanding this item and becoming familiar with it under all possible conditions is mandatory. It is not a flotation device. If an unexpected submersion in water occurs, they should be doffed immediately and quickly. The shorts may have to be put on or taken off at night or while wearing gloves. And the shorts are not flame retardant or fireproof.

The shorts come from the manufacturer, complete, ready to wear, and with the most important part, the ballistic panels, carefully installed inside. The shorts are designed for and are ready for standard combat and tactical operations and conditions. The ballistic protective panels should not be removed. The protective ballistic panels should never be submersed in water, washed, dry-cleaned, subjected to chemicals, bleaches, fuels, oils, or antifreeze.

Each set of shorts comes with a care and use label. The information on this label should be strictly followed. Only under special circumstances, should the ballistic panels be removed. If a special circumstance occurs, the panels should be removed carefully. When reinserted each panel is labeled to identify its proper location within the shorts. Accordingly, the panels should be reinserted matching the hook and loop strips, and according to the label.

Improper care or misuse of the product can compromise the integrity of its ballistic properties and consequently the protective value of the unit.

CONCLUSION

The foregoing description is illustrative of the features and benefits of the invention but is by no way intended to be limiting. Those skilled in the art will recognize that various substitutions and modifications may be made to the invention without departing from the scope and spirit of the invention which is described above and defined by the following claims.

I claim:

1. A tactical outer protective shorts, comprising:

a first front ballistic panel comprising a plurality of layers of ballistic material for overlying the left front lower torso, a second front ballistic panel comprising a plurality of layers of ballistic material for overlying the right front lower torso, a first rear ballistic panel comprising a plurality of layers of ballistic material for overlying the left rear lower torso, a second rear ballistic panel comprising a plurality of layers of ballistic material for overlying the right rear lower torso, a panel carrier garment suitable for wearing over a uniform having the general appearance of a pair of shorts, comprising a front torso portion and a rear torso portion, said front torso portion containing said first and second front ballistic panels, said rear torso portion containing said first and second rear ballistic panels, and a shoulder harness connected to said front torso portion and rear torso portion of said panel carrier garment.

2. The tactical outer protection shorts according to claim 1, wherein said front torso portion and said rear torso portion of said panel carrier garment are connected in a crotch portion.

3. The tactical outer protection shorts according to claim 1, wherein said front torso portion and said rear torso portion of said panel carrier garment have side edges which are joined together in an overlapping arrangement by a plurality of adjustable connectors.

4. The tactical outer protection shorts according to claim 1, wherein said front torso portion of said panel carrier garment includes a fly zipper in a crotch portion.

5. The tactical outer protection shorts according to claim 1, wherein said first and second front ballistic panels and said first and second rear ballistic panels include a panel cover over said plurality of layers of ballistic material, said panel cover having a plurality of hook or loop strips disposed thereon for securing said ballistic panels to corresponding hook or loop strip on the inside of said front torso portion and said rear torso portion.

6. The tactical outer protection shorts according to claim 1, wherein said front torso portion and said rear torso portion of said panel carrier garment have openings for removal of said first and second front ballistic panels and said first and second rear ballistic panels from said panel carrier garment.

7. The tactical outer protection shorts according to claim 1, wherein said plurality of layers of ballistic material are stitched together.

8. The tactical outer protection shorts according to claim 3, wherein said plurality of adjustable connectors are three quick release buckles.

* * * * *